United States Patent [19]

Bodenmann

[11] 4,251,003

[45] Feb. 17, 1981

[54] BOTTLE CLOSING DEVICE

[75] Inventor: Peter Bodenmann, Pfaffhausen, Switzerland

[73] Assignee: Toni Casutt, Zollikon, Switzerland

[21] Appl. No.: 4,666

[22] Filed: Jan. 19, 1979

[51] Int. Cl.[3] ..... B65D 41/58

[52] U.S. Cl. ..... 215/254; 215/272

[58] Field of Search ..... 215/272, 277, 254, 251

[56] References Cited

U.S. PATENT DOCUMENTS

| | | | |
|---|---|---|---|
| 1,609,453 | 12/1926 | Atwood | 215/272 |
| 2,444,779 | 7/1948 | Krasberg | 215/272 |
| 2,586,440 | 2/1952 | Satz | 215/272 |
| 2,860,802 | 11/1958 | Gold | 215/272 |
| 2,865,525 | 12/1958 | Satz | 215/272 |
| 2,903,148 | 9/1959 | Keller | 215/272 |
| 2,940,628 | 6/1960 | Schultz | 215/272 |
| 3,480,171 | 11/1969 | Rohde | 215/254 |
| 3,587,899 | 6/1971 | Bender | 215/307 |
| 3,630,405 | 12/1971 | Podesta | 215/254 |

FOREIGN PATENT DOCUMENTS

| | | | |
|---|---|---|---|
| 1032382 | 7/1953 | France | 215/254 |
| 1533368 | 7/1968 | France | 215/254 |
| 505132 | 12/1954 | Italy | 215/254 |
| 639487 | 5/1962 | Italy | 215/254 |
| 200456 | 7/1923 | United Kingdom | 215/254 |

*Primary Examiner*—Donald F. Norton

*Attorney, Agent, or Firm*—W. G. Fasse; D. F. Gould

[57] ABSTRACT

The present bottle closing device is intended especially for a one time use, for example, in medication bottles. The closing device is constructed to function as a guaranteed seal and may enclose a sealing gasket or stopper received in an elastically yielding claw ring which has claws held engaged with a bottle mouth rim by a closing cap provided with a so-called rip-top or flip-top which is ripped away for opening the bottle and breaking the seal.

4 Claims, 6 Drawing Figures

BOTTLE CLOSING DEVICE

BACKGROUND OF THE INVENTION

The invention relates to a bottle closing device, especially constructed for a one time use in connection with bottles for holding medicines or the like.

Bottle closure devices are known in many different modifications including so-called crown caps, twist-off caps and many other versions. However, prior art bottle closure devices do not combine the features which are desirable for special purposes such as the closing of medicine containing bottles. Such closing devices must guarantee that the content of a bottle is the original filling and not some substitute or refill.

OBJECTS OF THE INVENTION

In view of the above it is the aim of the invention to achieve the following objects singly or in combination:

to construct a single use bottle closing device which may, on the one hand, be easily opened, and which at the same time guarantees the original content of the bottle;

to construct a closing device for a bottle intended for heat sensitive contents which may be subjected to a freeze-drying process without affecting the effectiveness of the closing device;

to construct a bottle closing device capable of accepting various type of sealing members, for example, a rubber stopper or the like; and to construct a bottle closing device suitable for mass production at minimum expense.

SUMMARY OF THE INVENTION

According to the invention there is provided a bottle closing device which is characterized in that a claw ring made of an elastic material reaches under a bottle rim and that a cap or bonnet type cover is placed on said claw ring to press the claw or claws of the claw ring inwardly against the bottle rim. Locking means are operatively interposed between the cap or cover and the claw ring to prevent lifting off the cover after the bottle has been closed or sealed. The cap or cover is provided with a so-called flip-top or rip-top including points or lines of reduced strength for removing the cover from the claw ring when the bottle is to be opened.

It is especially simple to secure such a bottle closing device to the bottle mouth. In addition, the device may be produced at relatively low costs by mass production methods. Since the closing device cannot be removed without destroying it, it is especially suitable for guaranteeing the original content of a bottle, such as a medicine bottle. The closing device is also suitable for bottles that must be subjected to a freeze-drying process. For this purpose a sealing device such as a rubber stopper is inserted into the claw ring and the dimensions of the claw ring and of the cover or cap as well as of the bottle rim are selected so that the sealing device such as a flange of the rubber stopper is compressed when the device is in the bottle closing position.

BRIEF FIGURE DESCRIPTION

In order that the invention may be clearly understood, it will be described, by way of example, with reference to the accompanying drawings, wherein.

Figure 1:
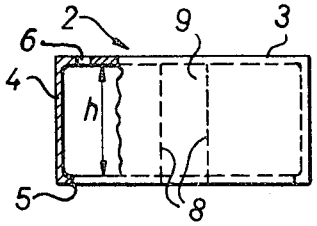
FIG. 1 is a side view partially in section, of a cap as used according to the invention.
Figure 2:
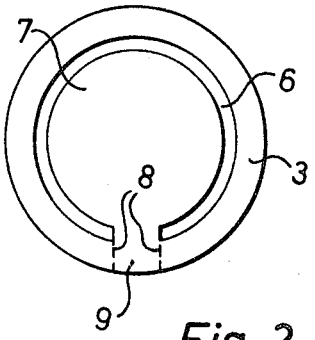
FIG. 2 is a top plan view of the cover of FIG. 1.

DETAILED DESCRIPTION OF PREFERRED EXAMPLE EMBODIMENTS AND OF THE BEST MODE OF THE INVENTION

The present bottle closing device comprises a bonnet type cover 2 preferably made of a single piece of a spring elastic synthetic material such as polyamide or PVC.

The cover has a facing surface including a radially inwardly extending rim 3 and a flip-top handle 7 separated by a gap 6 except in the area of a bridging tongue 9. The cover further comprises a substantially cylindrical jacket 4 merging at its upper end into the rim 3 and provided at the lower end with a ring bead 5 reaching substantially radially inwardly thereby reducing the radially open clearance at the lower end of the cap 2 by about 0.4 to 0.6 mm. The ends of the substantially ring shaped slot 6 are spaced from each other by the width of the tongue 9 which is connected to the rim 3 and to the cylindrical jacket 4 through lines 8 of reduced strength or perforations. Such lines could be grooves which do not completely penetrate through the material of the cover 2. Thus, the lift off handle 7 may be lifted and pulled off along the lines 8 of reduced strength whereby the handle 7 and the tongue 9 may be ripped off together for opening the cover 2.

Figure 3:
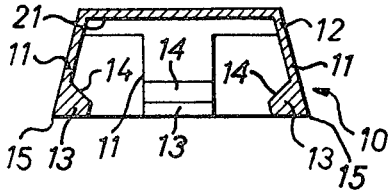
FIG. 3 is a sectional view through the claw ring according to the invention.

FIG. 3 shows the claw ring 10 according to the invention which is also made of a synthetic material having spring elastic characteristics, for example, polyamide.

The claw ring 10 comprises several claw members 11 extending away from the upper edge 12. FIG. 3 illustrates, for example, an embodiment with four claw members of which 3 are visible in FIG. 3, whereas the fourth claw member is not seen in FIG. 3 due to the sectional view. The claw members 11 are circumferentially spaced, for example, at 90° spacings. However, the number of claw members 11 could be larger or smaller than four such members. The claw members 11 extend at an angle somewhat radially outwardly and downwardly. Each claw member 11 is provided at its lower end with a claw 13 proper having a radially inwardly pointed slanted surface 14 and an outer edge 15 which is relatively pointed for engaging behind the lower rim or bead 5 of the cover 2. The outer diameter of the upper edge 12 of the claw ring 10 is somewhat smaller than the clearance diameter of the cover 2 in the range of the inwardly pointed bead 5. The lower end of the claw ring 10 has a diameter as defined by the outwardly pointing edges 15 which is larger than the inner diameter of the cover 2 in the unassembled condition of the claw ring 10 as shown in FIG. 3.

Figure 4:
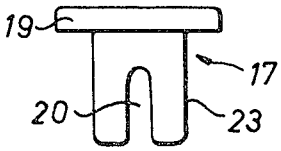
FIG. 4 illustrates a sealing element such as a rubber stopper which may be used in accordance with the invention.

FIG. 4 shows a side view of a rubber stopper which is especially used for closing bottles 18 containing medicines which require a freeze drying operation. The rubber stopper 17 comprises a flange member 19 extending radially out of the substantially cylindrical body 23 of the stopper 17 at the upper end thereof. The body 23 of the stopper 17 is provided with a centrally extending slot 20 opening downwardly. The slot 20 extends for about $\frac{2}{3}$ for the length of the stopper body 23 below the flange 19 from the lower end upwardly.

Figure 5:
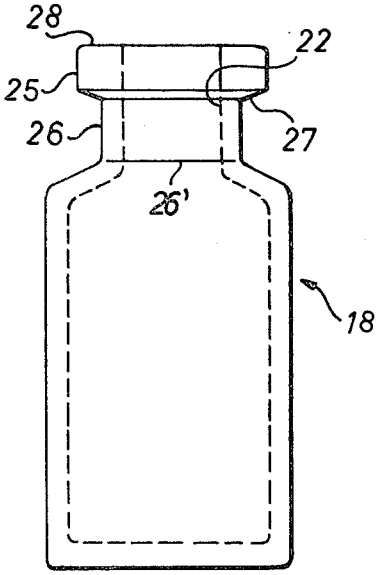
FIG. 5 illustrates a bottle, for example, a glass or plastic bottle especially suitable for medicines.
Figure 6:
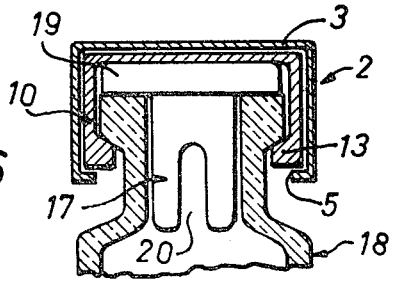
FIG. 6 is a sectional view through the present bottle closing device in its bottle closing position.

The downwardly facing surface of the flange 19 is intended to rest on the upper edge 28 of the bottle mouth of the bottle 18 as best seen in FIGS. 5 and 6. The top surface of the flange 19 comes to rest against the inner shoulder 21 on the inner surface of the claw top 12. The cylindrical stopper body 23 is supposed to snuggly fit into the opening 22 in the bottle neck. Referring further to FIG. 5 the bottle neck is provided with a radially outwardly extending rim 25 and with a bottle neck 26 having a radially reduced outer diameter as compared to the outer diameter of the rim 25. The bottle neck 26 and the rim 25 are connected to each other by a ring shaped slanted shoulder or surface 27 extending radially outwardly and upwardly at an angle relative to the longitudinal axis of the bottle. Such bottles are used for filling with special pharmaceutical products. The inclination of the ring shaped surface 27 corresponds, at least substantially to the inclination of the slanting surface 14 of the claws 13 in the claw ring 10.

Referring further to FIGS. 5 and 6 the closing of a bottle 18 is accomplished in the following manner. Initially the bottle is filled with the desired content to about the neckline 26'. Thereafter, the rubber stopper 17 is inserted into the bottle opening or mouth 22 to such an extent that the upper end of the slot 20 extending across the direction of insertion, extends above the upper edge 28 of the glass bottle. Thus, the slot still provides a communication between the surrounding atmosphere and the inner volume of the bottle. Thus, the purpose of the slot 20 in the stopper 17 is to permit the escape of water or other volatile component through the partially still open slot 20 during the subsequent freeze-drying process under the influence of reduced pressure and reduced temperatures. The stopper 17 is inserted in the claw ring 10 prior to insertion of the stopper into the opening 22. The inner dimensions of the claw ring 10 and of the stopper, especially of the stopper flange 19 are such that the stopper is held by a clamping action in the claw ring. Upon completion of the freeze drying operation, a downwardly directed pressure is exerted on the top surface of the claw ring 10, whereby the stopper 17 moves inwardly into the bottle opening 22 to such an extent that the flange 19 rests on the upper edge 28 of the bottle 18. Simultaneously, the claw members 11 are somewhat spread radially outwardly so that the claw members will slide over the rim 25 of the glass bottle 18. The claw ring 10 is so dimensioned that the surfaces 14 of the claws 13 will come to rest against the slanted surface 27 of the bottle 18. Thereafter, the cover 2 is placed from above onto the claw ring 10, whereby the claw members 11 are pressed radially inwardly because the inner diameter of the cover jacket 4 is smaller than the lower diameter of the claw members 11 when they are still under their radially outwardly directed biasing force. Thus, by pressing the cover 2 onto the claw members 11 the claws 13 proper are pressed against the glass bottle 18 and slanted surfaces 14 come to rest against the slanted surface 27 of the bottle 18.

At the end of the downward pushing of the cover 2 the cover rim 5 reaches such a position that the radially outer edges 15 of the claws 13 snap into position behind and just above the rim 5 whereby any unintended loosening or removal of the cover 2 is prevented after a proper closing of the bottle. The cover 2 is provided with an inner dimension or height "h" of such a length that in the closing position the cover 2 is able to just reach with its rim 5 underneath and against the edges 15 of the claws 13. Further, the dimension "h" is such that in the closed position the flange 19 of the rubber stopper 17 is maintained under a certain compression and thus in a bottle sealing condition under the pressure of the inwardly directed claws 13 of the claw ring 10.

In order to open the present closing device, the flip-top handle 7 is lifted and torn out of the cover along the lines 8 of reduced strength, whereby handle 7 and the tongue 9 are completely separated from the cover 2. Due to the spring elastic characteristic inherent in the cover 2 it will spread slightly radially outwardly after removal of the tongue 9, whereby the cover 2 may be easily removed from the claw ring 10 which may then also be removed along with the rubber stopper 17. The claw members 11, due to their spring elastic characteristics 10 to also spread radially outwardly away from the slanted surface 27. Thus, the claw ring 10 may also be easily removed.

Instead of using a rubber stopper 17 as shown in FIG. 4, a simple sealing ring having the shape of the flange 19 may be inserted against the shoulder 21 of the claw ring 10 as shown in FIG. 3. A simple sealing ring of cork, rubber, or synthetic material may thus be used instead of the rubber stopper 17 where the content of a bottle is not intended to be subjected to a freeze drying operation.

Although the invention has been described with reference to specific example embodiments, it will be appreciated, that it is intended, to cover all modifications and equivalents within the scope of the appended claims.

What is claimed is:

1. A device for closing the mouth of a bottle used in a freeze drying operation, which mouth is surrounded by a radially outwardly extending bottle mouth rim having a given outer diameter, comprising cap means (2), claw ring means (10) made of a synthetic material, sealing stopper means operatively located in said claw ring means, said sealing stopper means including a stopper body and radially extending flange means, said stopper body including axially extending slot means (20), said claw ring means including claw means (13) adapted to reach under said bottle mouth rim in the bottle closing position when said cap means encloses said claw ring means (10) whereby the cap means presses the claw means substantially radially inwardly, said closing device further comprising locking means (5, 15) on said claw ring means and on said cap means, said locking means (5) of said cap means (2) snapping under said locking means (15) of said claw ring means (10) when the cap means (2) is pushed downwardly onto said claw ring means (10) whereby lifting off the cap means from the claw ring means, without destroying the cap means, is prevented when the latter are in the bottle closing position, said locking means comprising a bottom rim means (5) forming part of said cap means and facing substantially radially inwardly, said bottom in rim means (5) having an inner diameter sufficiently larger than said given outer diameter to provide for said snapping, said claw means (13) comprising radially outwardly facing edges (15) for engaging said bottom rim means (5) when the device is in the bottle closing position, said claw means being normally biased radially outwardly for permitting said snapping of said edges (15) into engagement with said bottom rim means (5) of said locking means whereby said bottom rim means reaches under said claw means in the bottle closing position and forces the claw means to engage the bottle mouth rim, and flip top means (7,8) forming part of said cap means for removing said cap means from said claw ring means, said axially extending slot means (20) of said sealing stopper means providing for venting said bottle prior to completely inserting said sealing stopper means into the bottle mouth and then sealing the latter when the sealing stopper is completely inserted, said cap means comprising a top surface including top rim means and lateral wall means extending substantially perpendicularly to said top rim means, said flip top means including handle means (7) normally extending substantially in the plane defined by said top surface and top rim means, gap means (6) substantially separating said handle means (7) from said top rim means (3), tongue means (9) connecting said handle means (7) to said top rim means (3) across said gap means (6) and to said lateral wall means, and reduced strength means (8) operatively interposed between said tongue means (9) and said top rim means and between said tongue means and said lateral wall means for pulling said flip top means out of said cap means to open a bottle.

2. A bottle for holding freeze dried medicines and closure device for said bottle, comprising bottle neck means including a bottle mouth and a mouth rim surrounding said bottle mouth radially outwardly thereof, said mouth rim including a ring surface slanting radially outwardly and upwardly as viewed from the central longitudinal axis of said bottle, whereby said mouth rim merges into said bottle neck means with said ring surface, said mouth rim having a given outer diameter, ring claw means including elastically yielding claws for engaging said slanting ring surface of said bottle mouth rim, and cap means snap fitting on said ring claw means for keeping said claws engaged with said ring surface, said cap means comprising flip top means (7,8) for removing said cap means from said bottle mouth, and sealing stopper means (17) in said ring claw means, said sealing stopper means having a stem of given length, a flange at one end of said stem, and slot means (2) extending in the axial direction of the stem of the sealing stopper means, said axially extending slot means having an axial length below said flange corresponding to about two thirds of the given length of said stem to permit venting of said bottle when said sealing stopper means (17) is inserted only partially into said bottle mouth and so as to completely seal said bottle mouth when said sealing stopper means is fully inserted into said bottle mouth, said cap means comprising a bottom rim (5) facing substantially radially inwardly, said ring claw means comprising radially outwardly facing edges (15) for snapping engagement with said bottom rim (5) when the cap means is pushed downwardly onto said claw ring means whereby lifting off the cap means from the claw ring means, without destroying the cap means, is prevented when the claw ring means are held in the bottle closing position by the cap means, said bottom rim (5) having an inner diameter sufficiently larger than said given outer diameter to provide for said snapping engagement and to force the claw means to engage the bottle mouth rim.

3. The device of claim 2, wherein said cap means include top rim means having a top surface and lateral wall means, said flip top means including handle means which are normally coplanar with a central portion of said top surface of said cap means, said flip top means of said cap means further including tongue means and reduced strength means extending on both sides of said tongue means through said top rim means and through said lateral wall means.

4. The device of claim 1 or 2, wherein said cap means and said claw ring means are made of a spring elastic synthetic material.

* * * * *